US006098563A

United States Patent [19]

Walker

[11] Patent Number: 6,098,563

[45] Date of Patent: Aug. 8, 2000

[54] TANKER SPILLAGE PROTECTION SYSTEM

[76] Inventor: Evan Harris Walker, 219 W. Bel Air Ave., Suite 3, Aberdeen, Md. 21001-3256

[21] Appl. No.: 09/132,086

[22] Filed: Aug. 10, 1998

[51] Int. Cl.[7] ..... B63B 43/16

[52] U.S. Cl. ..... 114/227; 114/74 R; 114/228

[58] Field of Search ..... 114/227, 228, 114/229, 74 R; 324/444; 435/288; 367/149; 44/270

[56] References Cited

U.S. PATENT DOCUMENTS

| | | | |
|---|---|---|---|
| 424,508 | 4/1890 | Shone | 114/68 |
| 534,611 | 2/1895 | Marsden | 114/69 |
| 1,320,012 | 10/1919 | Lee et al. | 114/68 |
| 1,321,325 | 11/1919 | Olsen | 114/69 |
| 1,428,461 | 9/1922 | Waitz | 114/68 |
| 2,966,131 | 12/1960 | Elijah | 114/68 |
| 3,460,921 | 8/1969 | Winkler | 44/270 |
| 3,536,260 | 10/1970 | Volz . | |
| 3,622,437 | 11/1971 | Hobaica et al. | 114/69 |
| 3,789,791 | 2/1974 | Lent et al. | 114/227 |
| 4,656,427 | 4/1987 | Dauphinee | 324/444 |
| 4,660,491 | 4/1987 | Murata et al. | 114/65 R |
| 5,085,161 | 2/1992 | Cuneo et al. | 114/65 R |
| 5,116,759 | 5/1992 | Klainer et al. | 435/288 |
| 5,125,439 | 6/1992 | Perkins | 114/11 |
| 5,189,975 | 3/1993 | Zednik et al. | 114/74 A |
| 5,203,272 | 4/1993 | Kassinger et al. | 114/74 R |
| 5,218,919 | 6/1993 | Krulikowski, III et al. | 114/74 A |
| 5,247,896 | 9/1993 | Vosper | 114/74 R |
| 5,269,246 | 12/1993 | Goldbach et al. | 114/45 |
| 5,320,056 | 6/1994 | Marinzoli | 114/74 R |
| 5,337,693 | 8/1994 | Ross et al. | 114/227 |
| 5,353,727 | 10/1994 | Goldman | 114/74 A |
| 5,421,281 | 6/1995 | Beyrouty | 114/228 |
| 5,503,291 | 4/1996 | Craig | 114/74 R |
| 5,504,720 | 4/1996 | Meyer et al. | 367/149 |
| 5,645,004 | 7/1997 | Holland | 114/211 |

*Primary Examiner*—S. Joseph Morano
*Assistant Examiner*—Lars A. Olson
*Attorney, Agent, or Firm*—Lieberman & Brandsdorfer, LLC

[57] ABSTRACT

The invention relates to a spillage protection system for a storage vessel in the event a breach of the hull occurs. The system comprises sheets of lath work panels extending from longitudinal and transverse supporting members of the vessel hull for forming sub-compartments therein. The sheets of lath work panels are comprised of a plurality of apertures therein for providing characteristics of strength and porosity to the structure. The system further comprises a distribution system extending through the hull of the vessel and into each of the sub-compartments. The distribution system originates at a reservoir which supplies a foamable cast-cure plastic material to the distribution system and effectively delivers the foamable cast-cure plastic material to a sub-compartment adjacent to an area of the hull experiencing the breach. In addition, the protective system comprises a sensing system in each sub-compartment for detecting a breach in the hull, as well as a control system for delivering the foamable cast-cure plastic material to an area of the hull being compromised. Accordingly, upon a breach of the hull, a fire resistant foamable cast-cure plastic material is delivered to a sub-compartment adjacent to the breach thereby forcing the seawater out of the sub-compartment and effectively sealing the breach.

29 Claims, 5 Drawing Sheets

105
106
104
103
35
38
104
14
32
102
109
16
107
30
108
40
34
18
101
10
20

TANKER SPILLAGE PROTECTION SYSTEM

BACKGROUND OF THE INVENTION

1. Field of the Invention

This invention relates to an apparatus and method of protecting a tanker and/or cargo ship during breach of the hull. More particularly, this invention relates to a novel apparatus and method for protecting the tanker and preventing spillage of its contents from occurring during such a breach by means of sealing any ruptures in the hull with a foamable cast-cure plastic material.

2. Discussion of Related Art

Transportation of petroleum products, such as crude oil, on the open seas poses a risk to the environment as well as the potential for economic loss in the case of a breach of the hull of the vehicle with resulting spillage of the vehicle's cargo. One example of such an event is the Exxon Valdez oil spill in Alaska's Prince William Sound which occurred in March 1989. In 1990 the U.S. Government enacted the Oil Pollution Act of 1990 setting forth a more stringent set of requirements for construction of oil tankers and more specifically the design of the hull of such vehicles. This new law requires that all U.S. oil tankers be fitted with a double hull construction. Accordingly, the Oil Pollution Act of 1990 seeks to minimize the risk to tanker type vehicles of spillage to the vessel's contents resulting from a collision or grounding of the vehicle.

In a vessel containing a double hull construction, the outer walls of the vessel are effectively duplicated by means of a second set of rigid interior walls. The two sets of walls enclose an empty space which is generally filled with a non-flammable gas at such time as the vessel is in a standard operating mode.

There are several drawbacks associated with a double hull construction of a vessel such as an oil tanker. First, double hulled vessels are expensive to manufacture as well as to operate. In actuality they require building an entire second hull which must be constructed so as to withstand enormous loads. Construction in the form of retrofitting additional hulls inside vessels which are in service is very difficult, as well as expensive. Furthermore, due to the double hull structure, it is difficult to inspect and/or perform repairs within spaces between an outer hull and an inner hull in the event such action becomes necessary. Accordingly, there appears to be a need for an alternative to the conventional double hull construction for storage vessels which can provide added safety to the environment while avoiding the drawbacks and dangers associated with conventional double hull vessels.

In view of the prior art disclosed, there have been numerous proposals for avoiding the need for double hull construction of a storage vessel. For example, U.S. Pat. No. 1,320,012 to Lee et al. discloses a solution to salvaging a ruptured vessel compartment. The patent discloses the use of inflatable bags for deployment into a compartment which has been breached. The bags are filled with a gas until such time as the gas pressure inside the bags is equal to the pressure of the surrounding water. However, the Lee et al. patent fails to address the issues pertaining to the structural integrity of the inflatable bags against the forces acting across a large hull breach. Accordingly, the gas inflated bags may provide sufficient strength for a smaller size vehicle as well as a minor breach, however, when applying this apparatus to a tanker vessel, such a mitigating apparatus may not be sufficient to withstand the forces associated with a significant breach of the hull.

Furthermore, U.S. Pat. No. 2,966,131 to Elijah discloses the use of gas filled bags for sealing off a hatch opening in the event of a breach, as well as displacing water from the area where the breach has occurred. However, the disclosure does not appear to account for significant pressure applied to a vessel hull in the event of a breach. Although such a disclosure may be sufficient to withstand a breach of the hull in a smaller size vessel, the mechanics of the structure cannot be retrofitted to a storage vessel such as a conventional oil tanker or supertanker. The force of the water bearing against the hull in the event of a breach is enormous, and the sheets and pillows disclosed in the Elijah patent do not have the strength to withstand the pressure associated with such a breach. Accordingly, such a disclosure does not provide a means for sealing the breach and holding the seal for an extended period of time until such rupture may be cured.

U.S. Pat. No. 5,125,439 to Perkins discloses a construction similar to a double hull construction, wherein foam prevents evaporation of vapors. However, the Perkins patent does not teach a liquid polymer for sealing the compartment in the event of a breach, nor does it disclose a foam comprising strength and buoyancy to seal the breach without compromising the integrity of the hull as aqueous foam does not provide such properties. Accordingly, the Perkins patent neither provides the structure nor the materials for sealing a compartment of the hull of a vehicle which has been ruptured.

In view of all of the disclosures which provide means for filling hull compartments with gas inflated bags or foam material for preventing evaporation of vapors, none provide a compact apparatus for directing a foamable cast-cure plastic material to the site of the hull breach, wherein such polymer seals the breach and comprises sufficient strength to withstand the pressure of the external water applied to the area of the breach. Accordingly, there remains a need for a feasible and effective alternative to the conventional double hull construction which can be retrofitted to existing vessel so as to overcome the obstacles associated with conventional double hull construction.

Therefore, what is desirable is an apparatus and method for providing the protection of a conventional double hull to both existing and new tanker constructions at a relatively inexpensive cost. The novel double hull construction incorporating the spillage protection system provides a superior level of protection against cargo loss while providing a compact apparatus for delivering a material to the area of breach without compromising the structure or cargo capacity of the vessel.

SUMMARY OF THE INVENTION

It is therefore the general object of the present invention to provide an apparatus for protecting the hull of a vessel such as a tanker, or similar vessel, in the event of a breach or rupture of the hull.

It is a further object of the invention to provide a novel system for sealing a breach occurring in the hull of the vessel with a liquid polymer material or an equivalent material comprising a similar quality and strength which shall prevent or minimize leakage of any cargo stored within the vessel. By sealing a breach of the hull with a foamable cast-cure plastic material having the strength to withstand the force of water upon the breach, the invention permits the vessel to remain afloat and prevent damage to the environment and loss of cargo.

It is an even further object of the invention to provide a novel apparatus within the hull of the vessel, comprising a plurality of pipes and sensors for determining the presence of a breach in the hull, and in the event such a breach occurs for delivering the foamable cast-cure plastic material to the location of the breach. At such time as a breach is detected, the sensor communicates with a polymer reservoir and the foamable cast-cure plastic material is delivered to the location of the breach.

Furthermore, it is a further object of the invention to provide a kit for retrofitting the disclosed apparatus to existing vessels.

In accordance with the invention, these and other objectives are achieved by providing an apparatus for retrofitting existing single hull tanker vessels with an active double hull construction comprising a piping system extending throughout the active double hull for delivering a thermoplastic liquid polymer material to an area of the outer vessel hull experiencing a breach. Accordingly, the novel apparatus enables conventional vessels to be retrofitted with a extensive piping system connected to a cental polymer reservoir together with a breach detection apparatus for delivering the material to the specific area of the outer hull affected by the breach.

BRIEF DESCRIPTION OF THE DRAWINGS

These and other objects, features and advantages of the invention, as well as the invention itself, will become better understood by reference to the following detailed description when considered in connection with the accompanying drawings, wherein.

DETAILED DESCRIPTION OF THE PREFERRED EMBODIMENTS AND BEST MODE OF THE INVENTION

Figure 1:
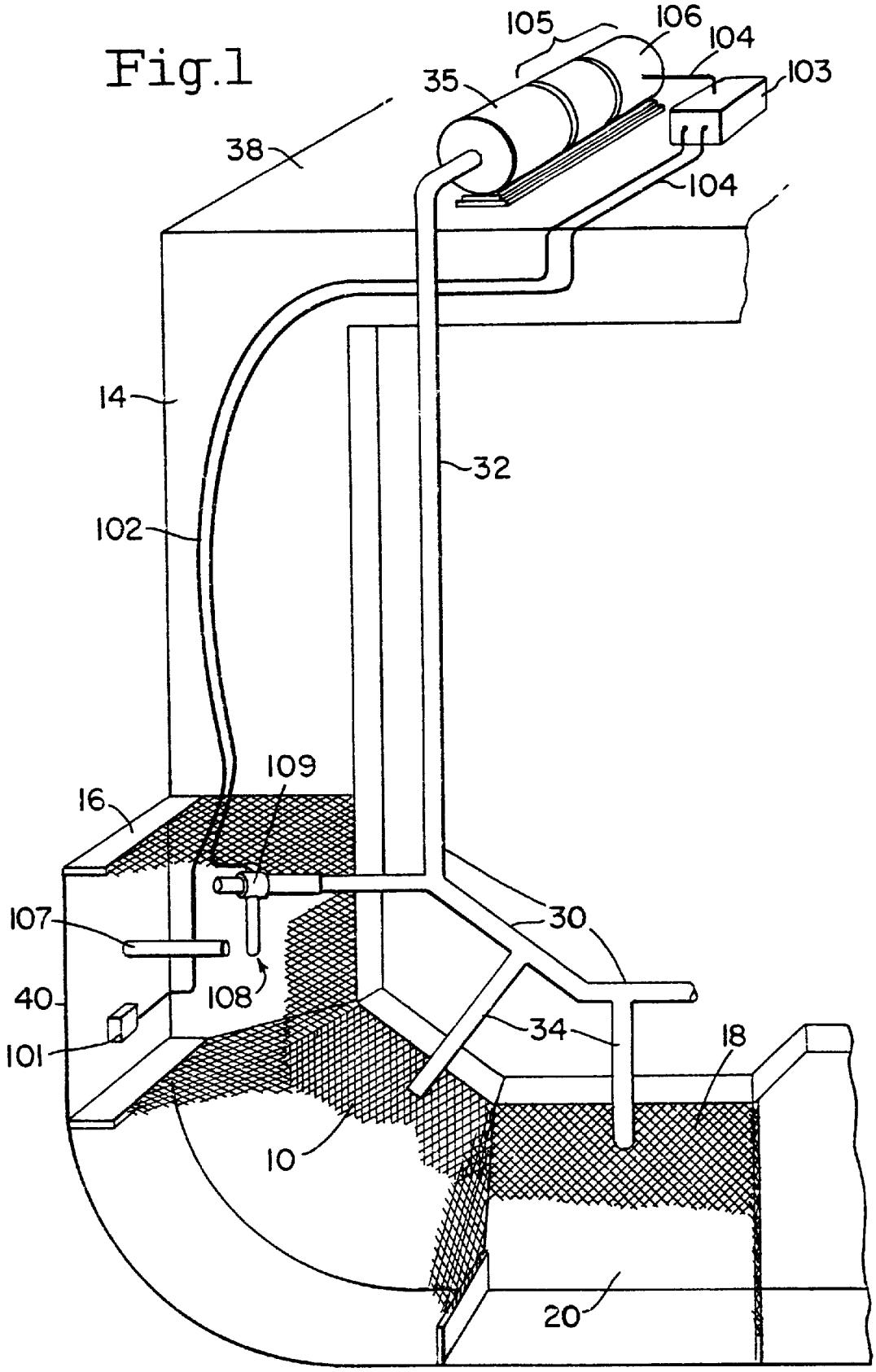
FIG. 1 is a schematic illustration of the novel active double hull protection system.

Although the disclosed invention may have broad applicability, it relates primarily to an apparatus for protecting the hull of a tanker type vessel, and more specifically to an apparatus and method for protecting the hull of the vessel in the event a rupture of the hull occurs. This invention is applicable to all tanker type vehicles used for transporting goods long distances across great bodies of water. The following description will indicate certain items as reoccurring in several of the drawing figures. It is to be understood that each number performs the same function as the illustrated item in another figure. Accordingly, it should be noted that like reference numerals are used throughout the attached drawings to designate the same or similar elements or components.

In a conventional vessel, the hull is constructed with essentially one layer of protective guard. It has been demonstrated in recent history that such a construction is not a viable safeguard to our environment. Such construction leads to great environmental disasters at such time as a rupture or breach of the single layer hull occurs. Recently, the United States Government passed legislation requiring all tanker type vessels to be constructed with a double hull construction so as to provide added safeguards against reoccurrence of the environmental disasters of the past. However, such construction has proven to be expensive and time consuming. Accordingly, the novel construction and arrangement of the proposed protection system provides improved protection to the vessel in the event a breach occurs with a lightweight and cost-efficient means of retrofitting existing vessels.

While the force of seawater entering a large hull breach is quite substantial, the pressure exerted by the seawater is quite modest. For example, the force exerted through a 10 foot by 10 foot opening in a hull will approximate one hundred tons, while the pressure being exerted on the entire hull will typically be only 10 to 30 psi. Furthermore, the hull of a petroleum tanker experiencing an equivalent breach will be exposed to approximately 1.7 psi at a depth of thirty feet below the water surface and approximately 4 psi at a depth of seventy feet below the water surface. Accordingly, by sealing a breach in the hull with a foamable cast-cure material of sufficient strength to withstand the above discussed pressure, loss of cargo and damage to the surrounding environment can be mitigated or entirely prevented.

The use of a "foamable cast-cure plastic" as the material to be introduced into the sub-compartment or into sub-bags, as described elsewhere in this document, is the preferred practice for the implementation of the present invention, and in particular for use in oil and petroleum tanker cargos. The term "foamable cast-cure plastic" is to be understood to mean, as it is presently used in the chemical industry, a material that can be cast into a mold, and that on being so cast cures by a procedure in which foaming of the material occurs during polymerization and curing of the plastic. The foaming of the cast-cure plastic usually occurs as a result of the release of gas concomitant to the polymerization chemical reaction that produces the plastic. However, the gas which can be injected during the curing process can be the result of additional chemical reaction designed to produce such gases, or can be the result of a drop in pressure or an increase in temperature that results in the gasification of a material mixed with the plastic precursor materials—the materials that polymerize to form the plastic. As a result of this foaming reaction, a small amount of material can be used to fill a large volume, and provide thereby a filling material having rigidity and solidity as needed to fill, seal and resist displacement from the filled volume. However, the disclosure should not be considered as limited to the foaming cast-cure plastic material described herein. Alternative materials other than plastics can be used to form fills that will meet the compartment filling and sealing requirements as described in the present disclosure and such alternatives are to be considered covered by this disclosure. The use of such alternative materials can be of particular importance when the nature of the cargo to be transported by the tanker has a chemical incompatibility with plastics. Accordingly, in general, over and above the use of the preferred practice, the combination of any two or more materials that are liquid or that can be fluidized adequately for injection into the sub-compartments or sub-bags and that will react to form a fill adequate to seal and resist the forces to which the fill will be subjected will serve as a suitable alternative to the preferred practice.

Figure 2:
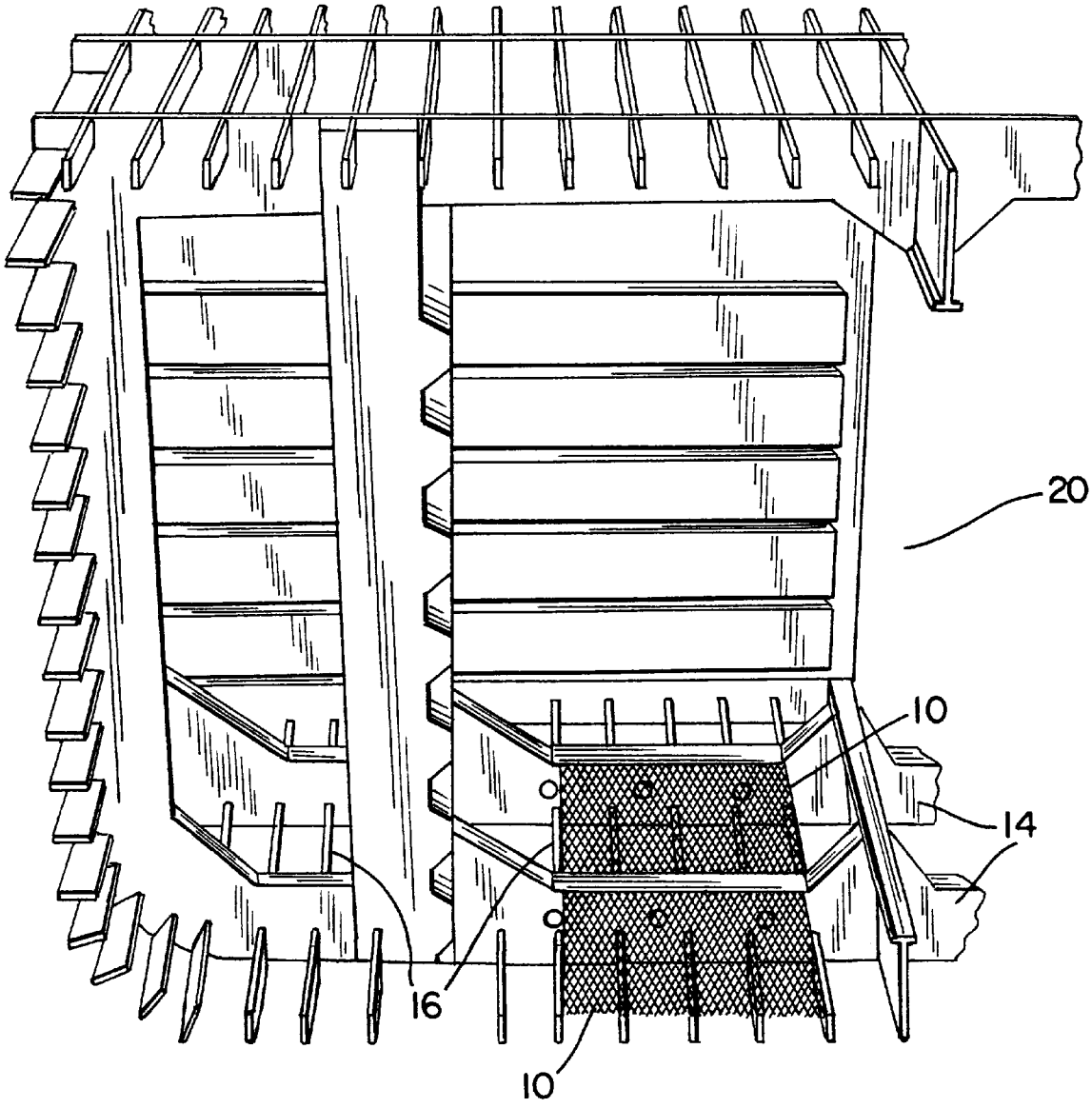
FIG. 2 is a schematic illustration of a novel tanker framing illustrating the lath work panels forming the inner hull of the novel active double hull protection system.

To properly seal a breach in the hull of a vessel by means of the present teaching, a foamable cast-cure plastic material must be properly prepared and placed in the breach in such a manner as to withstand the force and pressure exerted by the entering seawater. As illustrated in FIGS. 1 and 2, the hull of the vessel must be fitted or retrofitted with a lath work panel 10 comprising an inner hull 18 which is welded or possibly bolted to existing transverse framing members 14 and longitudinal framing members 16 of the vessel. A chambered inner hull 18 may be constructed so as to retrofit an existing hull without the need for bringing the vessel into dry-dock. In a preferred embodiment and the best mode of the invention, the inner hull 18 comprises a lath work panel 10 comprising sub-compartments 20 within an existing hull. This lath work panel structure will allow petroleum to readily flow into or out of the sub-compartments 20 so as to minimize or prevent any loss of cargo space. FIG. 2 illustrates two lath work panels 10 placed between two transverse framing members 14 for partially compartmentalizing a portion of the hull bottom. These lath work panels 10 are porous in structure and do not materially interfere with loading or unloading of the vessel, or the cargo space within the vessel. However, the full lath work panel structure essentially creates an inner hull for the vessel. Accordingly, in the event the outer hull of the vessel is breached, these lath work panels 10 function as the inner hull surface of the double hull with the foamable cast-cure plastic material providing the seal for the porous lath-work.

A schematic presentation of the inner hull is shown in FIG. 1. The inner hull 18 comprises three subsystems. The first subsystem comprises sheets of lath work panels 10 which are bolted or welded to transverse framing members 14 and longitudinal framing members 16. In the case of a new construction of a vessel, such a construction may be incorporated into the ship design. The second subsystem comprises a distribution system 30 illustrated in FIG. 1 capable of delivering a liquid polymer, or comparable foamable cast-cure plastic material, to any breached sub-compartment 20 of the lath work panel 10. Finally, the third subsystem comprises a sensing and control system for activating and monitoring injection of a foamable cast-cure plastic material into any sub-compartment 20 of the lath work panel structure which may be compromised. The sensing and control system is comprised of sensors 101 mounted in each sub-compartment, cable connections 102 extending from a sub-compartment to a central control box 103, and power lines 104 extending from the control box 103 to a pump or valving system connected to the distribution system 30 in the second subsystem. Accordingly, the three subsystems of the novel invention comprises a means for retrofitting an existing vessel with a means for retaining hull integrity in the event a breach occurs.

Referring to FIG. 2, the sub-compartments 20 of the first subsystem are preferably constructed out of light sheets of steel, similar to steel grillwork used to form catwalks on vessels. These sheets of steel are porous and relatively light and are appropriately welded, or otherwise secured, to the transverse framing members 14 and longitudinal framing members 16 of the vessel's framing structure. Once secured, the lath work panels 10 serve to effectively define an inner hull surface and to divide the double hull into a plurality of sub-compartments 20 about the perimeter of the vessel. Each of the sub-compartments 20 may range from a volume of 1,000 cubic feet in smaller tankers to about 40,000 cubic feet in large tankers. In a preferred embodiment, the lath work panels 10 may be comprised of a steel type material. However, instead of a steel type material the lath work panels 10 may be comprised of another material having suitable or similar quality and strength, provided that the material of the lath work panels 10 enables it to accommodate the essential functions of the lath work panels 10. The lath work panels 10 can be substituted or augmented by spaced planking, baffles, porous walls, or a similar means for differentially limiting access to an enclosed space based upon difference in viscosity between the liquid cargo and the liquid polymer material. Accordingly, upon injection of the foamable cast-cure plastic material into any of the above described sub-compartments 20, the foamable cast-cure plastic material will expand to fill the sub-compartment 20, forming a water tight and oil resistant seal and force all foreign liquids from the sub-compartment 20 affected by the breach.

Computer modeling of the process of injecting a liquid polymer material into a sub-compartment 20 adjacent to the vessel hull plating 40 upon detection of a hull breach, together with chemical studies of foam polymers and seawater and petroleum products compatibility, establish and provide the basis for accuracy of the present determinations. Due to the density differences between oil and water and the fact that the total weight of a vessel must be supported by the buoyant forces on a ship, the pressure differential, $\Delta p$, across a breach in a vessel's hull is dependent upon the depth of the breach below the water surface H, the density of the seawater $\rho_{sw}$ the displacement of the vessel, and the deadweight of the ship according to the following expression:

$$\Delta p = gH\rho_{sw}\left(\frac{1 - \text{Deadweight}}{\text{Displacement}}\right)$$

where g is the acceleration of gravity. For example, a vessel having a deadweight of 211,469 long tons and a displacement of 241,580 long tons in seawater at a density of 1.025 g/cm$^3$, gives 1.7 psi for the pressure differential for a breach of the hull thirty feet below the water surface and only 3.9 psi at a depth of 64.5 feet.

From the Bernoulli equation, the speed, v, with which this pressure will drive seawater into the breach of the hull and allow oil to be release from the compartment can be calculated as:

$$v = \sqrt{\frac{2\Delta p}{(\rho_{sw} + \rho_{oil})}}$$

The sum of the sea water and oil densities, $\rho_{sw}$ and $\rho_{oil}$ respectively, takes into account the fact that the pressure must displace both fluids into and out of the compartment. The Bernoulli equation only provides an approximation of the velocity, but at the same time demonstrates the principles of the present teaching through the use of a closed form equation. This calculation takes into account the usual situation in which the external seawater pressure exceeds the internal petroleum pressure, which provides a bilateral exchange of fluids across the breach.

Accordingly, through the Bernoulli equation the time T required to fill a sub-compartment 20 of volume V in an active double hull protected vessel wherein the sub-compartment 20 serves as cargo space, may now be formulated as follows:

$$T = \frac{\left(\frac{V}{\frac{1}{2}A}\right)\left(1 + \frac{\rho_{oil}}{\rho_{sw}}\right)}{\sqrt{2gH\left(\frac{1 - \text{Deadweight}}{\text{Displacement}}\right)}}$$

The breach area is defined as A, and the factor of ½ accounts for the fact that for the bi-directional flow only half the opening area is available for the exit flow of the oil cargo. In the above disclosure, it has been indicated that the volume of each sub-compartment 20 is 1,000 cubic meters. In the Exxon Valdez incident, the rupture in the hull was 5.5 meters wide and 20 meters below the water surface. For the Exxon Valdez to have had a 1,000 cubic meter sub-compartment oil loss, the time required to sustain such a loss would be approximately 6.8 seconds. Accordingly, to provide for a ship of comparable design as the Exxon Valdez with a similar level of sustained damage, such a volume would have to have been filled with foamable cast-cure plastic material in a time comparable to approximately 6.8 seconds.

A method of injecting a foamable cast-cure plastic material in exactly the time T through a piping system with a cross sectional area B can be achieved by using two 12 inch pipes for delivery of a higher pressure foamable cast-cure plastic material. From Bernoulli's equation, we can determine this factor by calculating a pressure P on the bulk liquid polymer prior to expansion, and by utilizing an expansion factor of F given by:

$$P = \frac{1}{2}\rho_{bulk}\left(\frac{fV}{BT}\right)^2$$

where $\rho_{bulk}$ is the density of the plastic prior to expansion, wherein f being given by $f=1/F$. For example, using a polyurethane which provides a value of f=0.031, wherein 0.031 cubic feet is the unexpanded volume of each cubic foot of the foamable cast-cure plastic polyurethane fill of this instance as measured after expansion, and using a twelve inch diameter delivery pipe, a pressure of 300 psi at the nozzle is calculated. This analysis demonstrates how a foamable cast-cure plastic material will fill the required volumes in the needed time as to minimize or prevent oil spillage. Accordingly, by using the principles discussed above, the foamable cast-cure plastic material injection system can be designed to fit the specifications of any ship, and this apparatus and method can provide a means for sealing a rupture in the hull of the vessel nearly as fast as such a breach occurs.

Figure 3:
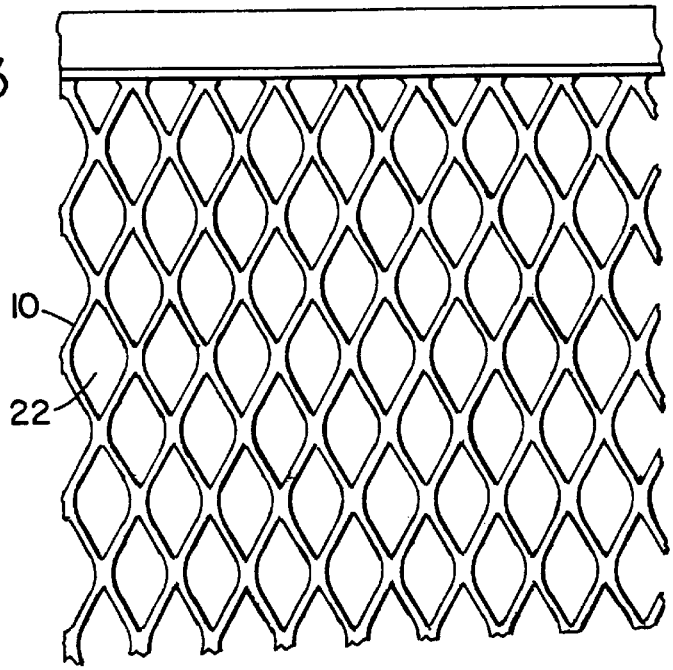
FIG. 3 is an illustration of the details in the lath work panels.
Figure 4:
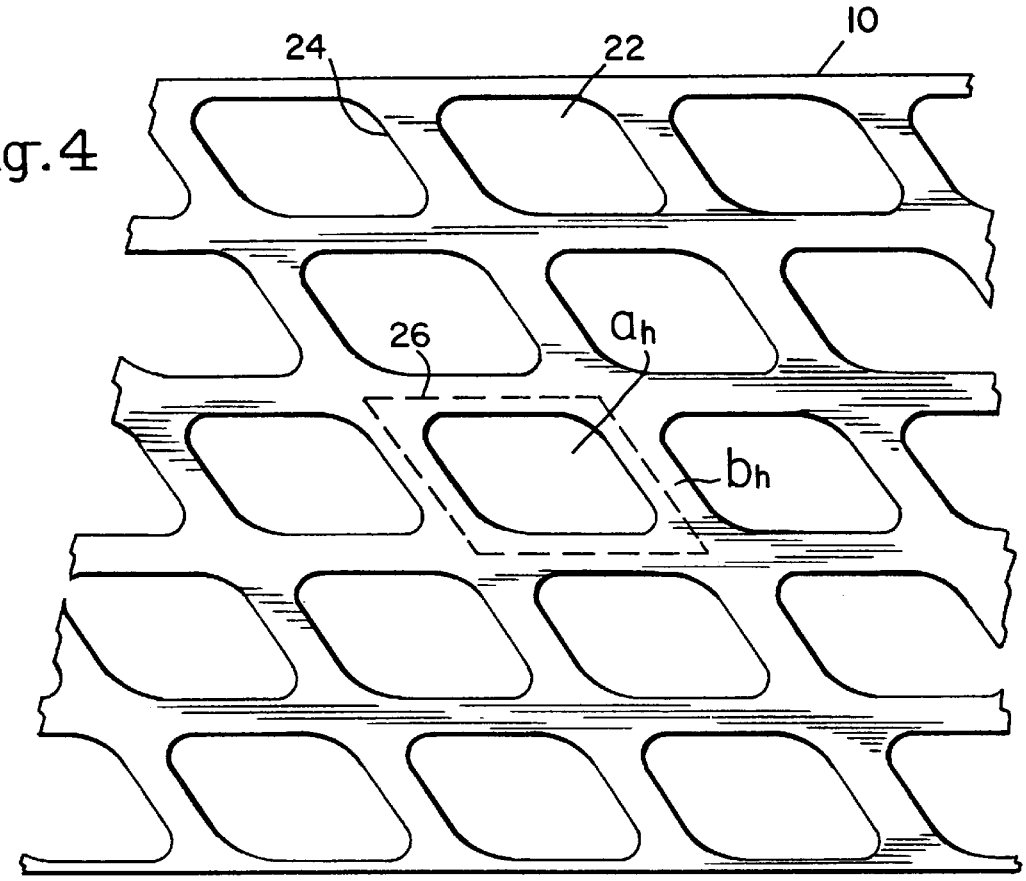
FIG. 4 is an enlargement of a portion of FIG. 3 illustrating the lath work cells.

In the first subsystem of the preferred embodiment of the invention, a lath work panel 10 illustrated in FIG. 1 serves to hold and support the thermoplastic liquid polymer against the pressure of the seawater and liquid cargo pressure differential. In addition, the lath work panel 10 permits the liquid cargo of the ship to enter and exit from a sub-compartment 20 formed by the lath work panel 10 and the inner hull structures. Thus, the apertures 22 of the lath work panel 10 must be small enough so that the liquid polymer material will not be pressed through the apertures 22 following polymerization of the fill material. In addition, the lath work panels 10 must be of a specific dimension to provide strength and porosity so as to permit the flow of the liquid cargo therein without altering the shape or structure of the lath work panels 10, or the ability of the lath work panels 10 to hold and support the foamable cast-cure plastic material against the pressure of the seawater and liquid cargo pressure differential. The apertures 22 in the lath work panel 10 may be of varying geometrical shapes and sizes. For example, the apertures 22 may be diamond shaped as shown in FIGS. 3 and 4, thereby reducing the weight of the wall, they may be circular to provide increased wall strength, or the apertures 22 may comprise a high perimeter to area ratio to reduce the tendency of the foamable cast-cure plastic material to flow through the lath work panel 10. Accordingly, by varying geometrical dimensions and shapes of the lath work panel 10, various benefits may be provided according to the specific needs and desires of the construction.

The minimum porosity of the lath work panel 10 is determined by the rate at which the sub-compartment 20 may need to be filled. For this purpose, the Bernoulli equation for calculating the rate of flow of the cargo for a given pressure, taking into account the viscosity of the liquid being considered, is adequate for determining the rate of flow of the cargo in a sub-compartment 20. The minimum porosity requirement is further limited by the restriction that this rate of flow allows the filling of the sub-compartment 20 in no more than the same amount of time than is required to fill the entire vessel cargo area exterior to the sub-compartment 20, from a level equal to the bottom of the sub-compartment 20 to a level equal to the top of the sub-compartment 20. Accordingly, such factors take into consideration that there should not be a significant added delay in filling the ship with its cargo.

The time T' to fill a sub-compartment 20 in the lath work is governed by the following equation:

$$T' = \frac{V}{P_1 A v}$$

where $P_1$ is the porosity (area of the apertures in the lath work panels divided by the area of the lath work panels), A is the area of the lath work panels separating the sub-compartment volume V to be filled from the part of the vessel's cargo space exterior to the sub-compartment 20, and v is the speed of the oil given by the Bernoulli equation. For improved accuracy, this may be corrected for viscosity based on aperture size in the lath work panels 10 which may be calculated using standard equations for fluid flow in which the aperture size to be used in the design and construction of the lath work must be selected preferably by an interactive calculation. Furthermore, selection of the porosity $P_1$ should be calculated by the following relationship:

$$\frac{V}{P_1 A v} < \frac{T_s h_s}{H'}$$

where $T_s$ is the time required to fill the entire ship, and $h_s$ is the height of the sub-compartment versus the draft of the ship, H'. That is to say, the porosity of the lath work panel is calculable from the inequality condition:

$$P_1 > \frac{V H'}{A v T_s h_s}$$

A second condition relevant to the calculation of the porosity of the lath work panel 10 requires that the pressure of the seawater pushing against the foamable cast-cure plastic material covering a breach of the hull be supportable by the lath work panel 10 in such a manner that the foamable cast-cure plastic material shall not extrude through the lath work panel 10 and fail to support the load that the seawater places on the breach. The delivery of the foamable cast-cure plastic material to the sub-compartment 20 effectively seals the porosity of the lath work panels 10, thereby enabling the lath work panels 10 to support the forces engaging the area of the hull breach. Referring to FIG. 4, which is an enlargement of a portion of FIG. 3 illustrating the lath work panel cells 22, repetition of a geometric cell pattern forms the specific lath work pattern. In FIGS. 3 and 4 the illustrated shape of the apertures is diamond in nature. It is important to note that the specific pattern used is irrelevant in that a non-repetitive pattern may be used as well as a non-diamond pattern, provided the porosity and sizing of the apertures of the lath work panel 10 enables it to accommodate the liquid polymer and to effectively seal the lath work panels, as well as provide the strength to withstand the forces engaging the area of the hull experiencing the breach. More particularly, FIG. 4 is an illustration of one cell 22 in the lath work panel 10. The open area of the cell 24 has an area $a_h$. In addition, 26 refers to an area taken around the perimeter of the cell 24 and the area consisting of the material of the lath work panel is designated as $b_h$. Given that $a_h$ is the area of a typical aperture in the lath work panel 10, and $b_h$ is the area surrounding the lath material in a unit, the porosity $P_L$ may be defined as:

$$P_L = \frac{a_h}{(a_h + b_h)}$$

The aperture size $a_h$ may be limited and calculated by the relationship of the pressure p of the sea water or the differential pressure of the liquid cargo and sea water as deemed appropriate, together with the shear strength of the foamable cast-cure plastic material, Ss, and may further be defined by the following relationship:

$$\frac{a_h}{b_h} < \frac{S_s}{p}$$

Accordingly, the aperture size in the lath work panel 10 is limited to the approximation provided in the above illustrated relationship.

Furthermore, as mentioned above the strength of the lath work panel 10 must be sufficient to support the load of the pressure of the seawater or the differential pressure of the liquid cargo and seawater as deemed appropriate. For example, if the lath work panel 10 is comprised of steel, and the lath work tests out as having a strength $S_L$ per unit cross section of the material, then for a pressure, or differential pressure, p, to be supported on a span of lath work with a dimension, w, defined as a length of the lath work panel 10, having a thickness $d_L$, it is required that the following relationship further defines a property of the lath work panel 10:

$$d_L > \frac{p\,w}{S_L}$$

Accordingly, such a property for steel can be achieved with a thickness of ¼ inch even for large sub-compartments of the vessel.

FIG. 1 further contains a schematic illustration of the second subsystem of the preferred embodiment of the invention. In the preferred embodiment of the invention, the active double hull system comprises an apparatus and method for constructing a system of double hull sub-compartments 20 by lath work panels 10 as is illustrated in FIGS. 1 and 2. The apparatus further comprises a distribution system 30 for providing for the delivery of foamable cast-cure plastic material to each sub-compartment 20. The distribution system 30 originates with a polymer reservoir 35 placed on the deck 38 of the vessel. The distribution system 30 extends from the polymer reservoir 35 throughout an interior portion of the vessel. Each sub-compartment 20 comprises a portion of the distribution system 30 extending from a main pipe 32, such that the extensions 34 and the main pipe 32 are essentially connected in series in relation to the main pipe 32. The extensions 34 each originate with the main pipe 32 and extend from an interior portion of the vessel piercing through the inner hull lath work panels 10 and into the sub-compartment 20, such that the exposed end of the pipe extension 34 lies within an interior portion of the sub-compartment 20, but does not extend beyond the outer hull plating 40. The distribution system 30 further comprises a pumping system 105 containing a pressurization apparatus 106 connected to the polymer reservoir 35 for delivering the foamable cast-cure plastic material from the polymer reservoir 35 through the main pipe 32 and the pipe extensions 34 into the sub-compartment 20. Accordingly, at such time as a sensor 101 may detect a breach in the outer hull 40 of the vessel, the thermoplastic liquid polymer material is delivered from the polymer reservoir 35, through the main pipe 32 and into the pipe extension 34 in the breached sub-compartment 20.

Several detection means can be incorporated into the lath work construction for sensing a breach in the hull of the vessel and the presence of seawater or other external fluids in one or several of the sub-compartments 20. Some of the systems which may be incorporated includes electrical, acoustical and mechanical sensing means, and sensors can be located within, adjacent to, or for some system types such as acoustical, at a distance from the sub-compartments 20. For example, in an electrical sensing structure, electrical detection of the conductive seawater or a change in resistivity as a different fluid flows through the breach may be incorporated into the sensing structure. Alternatively, a pressure detection system may be incorporated wherein the force rupturing through the hull causes a compression of the oil, liquid cargo, air or other substance in the sub-compartment 20 adjoining the hull.

Other breach detection means may further include: an acoustic sensing means, a photo detection means, or a tie rod mechanism. The acoustic sensing means incorporates the use of hydro phones placed in the fluid cargo. At such time as an impact upon the outer hull 40 of the vessel occurs, the hydro phones detect the sound of impact or explosion upon the hull and initiate activation of the spillage protection system. With the use of a photo detection means to sense a breach in the outer hull 40 of the vessel, a change in illumination within a sub-compartment 20 due to an outer hull breach may actuate an electronic sensing system and initiate the spillage protection system. Such a photo detection means can be utilized in the depths of seawater surrounding a vessel's hull bottom if external illumination is provided for actuating the system. The ties rod system incorporates tie rods into the structure of the steel lath work panels 10, wherein a rod 107 affixed to the outer hull mechanically transmits motion to a valve toggle 108 to open a valve 109 upon a breach of the outer hull releasing the foamable cast-cure plastic material through the extensions 34 of the distribution system 30. In each of the sensing and activation systems disclosed, a breach sensing system is located in each sub-compartment 20 so that activation of the foamable cast-cure plastic material delivery may be accurately implemented. Accordingly, upon detection of a hull rupture, the foamable cast-cure plastic material is delivered to the area in which a rupture is detected.

Each of the above systems can be calibrated using existing practices to transform and amplify the signal so that it can be used together with computer or other circuitry means to enhance its capabilities. Upon actuation, the circuitry means selectively engages valves 109, acting either in concert with or independently of mechanical actuation rods 107 and valve toggles 108, to open and fill the sub-compartments 20 adjoining the breach and other sub-compartments 20 as are deemed necessary, either through automation, computer control or by a manual override control system.

Figure 5:
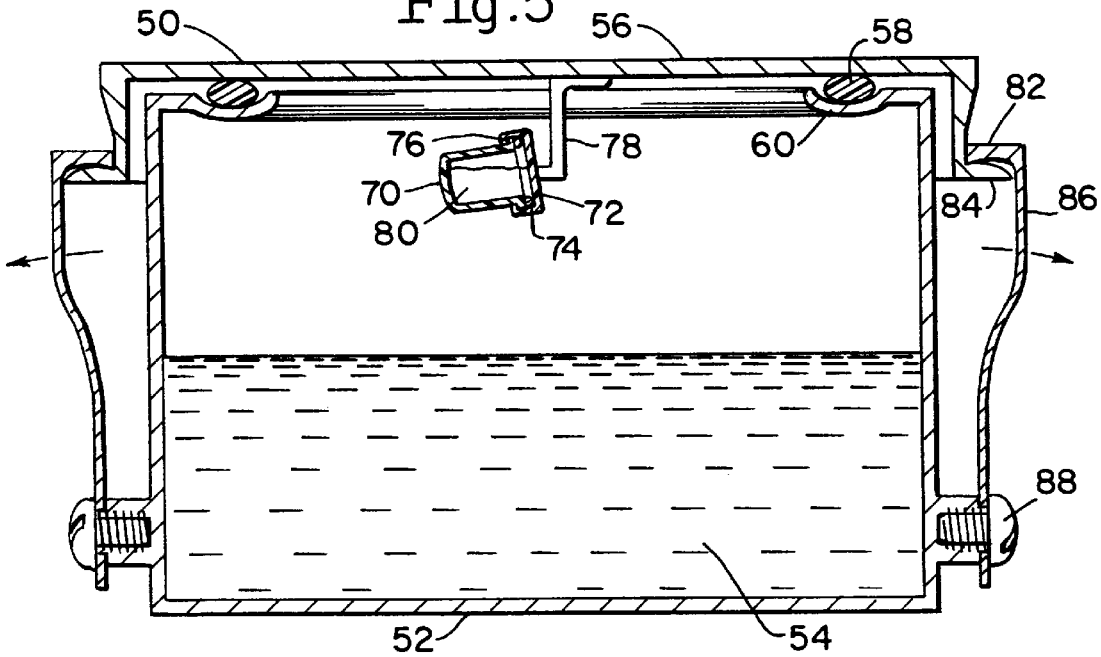
FIG. 5 is a foamable cast-cure plastic material dispensing unit.

FIG. 5 is a schematic illustration of an alternative embodiment of an apparatus 50 for releasing a foamable cast-cure plastic material to specific sub-compartments 20 of the vessel in the event a breach should occur. The apparatus 50 comprises a container 52 placed within a sub-compartment 20 in the event that a major system for distribution of a foamable cast-cure plastic material is not suitable. More particularly, the apparatus 50 comprises a container 52 filled with an unpolymerized polymer 54 stored under pressure. The container further comprises a lid 56 for covering the container having a gasket 58 and a gasket channel 60 for holding the non-polymerized polymer 54 in the container 52 under pressure.

Within the container 52 there is a second container 70 therein having a chemical additive being stored for initiating polymerization of the unpolymerized foam polymer 54. The second container 70 further comprises a lid 72 and gaskets 74 together with gasket channels 76 being attached to the lid 72 of the first container 52 by means of a connecting rod 78. Accordingly, At such time as the lid 56 of the first container 52 is removed, either mechanically or through the pressure of the contents within the containers 52 and 70, the contents 54 of the first container 52 will mix with the contents 80 of the second container 70 and a reaction will occur.

In addition, the first container 52 is equipped with a hook 82 for retaining the lid 56 against the gaskets 58 by hooking the lid 56 by means of a latch 84 onto a hook 82. The hook 82 is further connected to the first container 52 by a steel spring 86, or a spring comprised of an alternate material, and an attachment means 88. The spring 86 is held under tension. In order to remove the lid 56, the hook 82 must be moved away from the latch 84. At such time as sufficient pressure is applied to the lid to compress the gaskets 58, the latch 84 separates from the hook 82 and allows the tension exerted on the spring 86 to move the hook 82 away from the latch 84 allowing the removal of the lid 56. Accordingly, at such time as a compartment in which the container is located is under a pressure resulting from a breach of the hull, this pressure will cause the container unit 52 to release its contents and fill the sub-compartment 20 of the vessel with a foamable cast-cure plastic material.

The above discussed disclosure is principally intended to serve as a spillage or rupture protection system for vessels carrying petroleum products. Spillage or rupture to the hull of the vessel requires that the foamable cast-cure plastic material must comprise the properties to function in the presence of both oil and water. The chemicals used to form the liquid polymer protection layer within the proscribed double hull sub-compartments would be subject to contact and dilution by one or more water or oil based products. Because water is a polar compound and oil is non-polar compound, the environment in which the active double hull protective system would have to function could span the principle range of solvent material categories. This should not be interpreted to mean that the materials injected into the sub-compartments to form the foam would be dissolved by these solvents. These materials shall be mixed prior to injection, and these materials, once reacted to form the foam, are, by design, not soluble in the spectrum of liquids to which the foam may be exposed. However, it may be understood that some of the injected material and non-reacted or non-polymerized material at the interface between the injected foam precursor materials and the oil and/or water will be exposed to degradation by oil and/or water based products. Accordingly, improvement in the efficiency of this process suggests that this exposed interface be protected from such occurrence.

Figure 6:
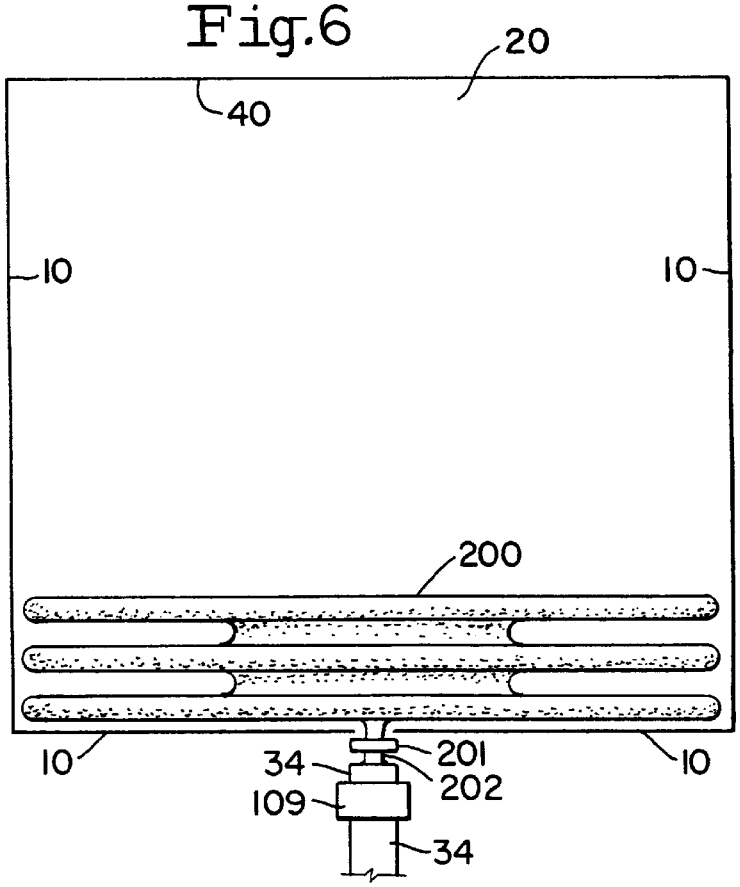
FIG. 6 is an illustration of an alternative embodiment illustrating the use of bags as buffers for the foamable cast-cure plastic during injection and polymerization with the bag collapsed and unfilled.

In a second alternative embodiment, protection for a brief time during the injection process can be achieved by the use of bags into which the precursor foam material is injected. Such a bag 200, as shown in FIG. 6, must comprise a structure capable of expanding with the foamable cast-cure plastic material during the foaming process, and capable of filling the proscribed double hull sub-compartment. Introduction of a bag 200, can provide consequential resistance to these forces, and so will prevent spillage of the contents of the petroleum contents stored in the vessel as well as a means for sealing the rupture and returning integrity to the structure of the vessel. In a preferred embodiment, the bag 200 may be comprised of a rubber or plastic material. However, instead of a rubber or plastic material, the bag 200 may be made from another material having suitable or similar quality and strength, provided that the material of the bag 200 enables it to accommodate the force being exerted on the bag during bag expansion as it is filled by the foamable cast-cure plastic material. The process of injecting the foamable cast-cure plastic material into an expandable bag 200 in a sub-compartment 20 provides a sufficient time interval for the foamable cast-cure plastic material to chemically react to take the form of a foam material having the characteristics and strength to resist the forces of the seawater while providing structural integrity to the damaged vessel's hull.

Figure 7:
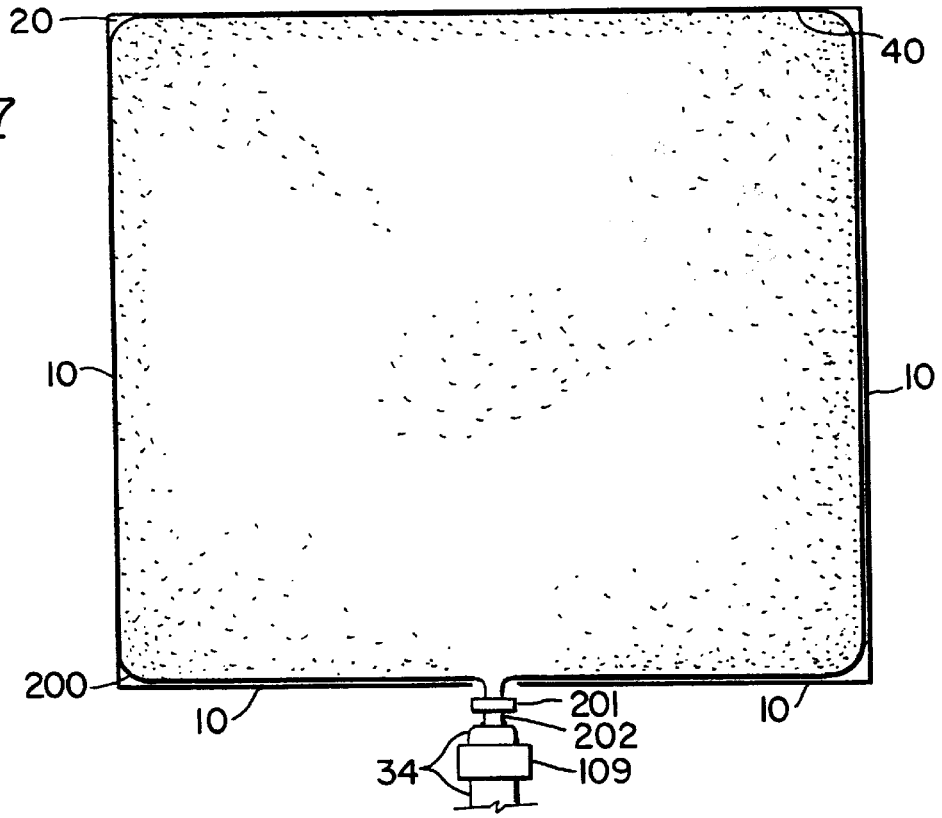
FIG. 7 is an illustration of the alternative embodiment of FIG. 6 illustrating the bag extended so as to fill a sub-compartment.
Figure 8:
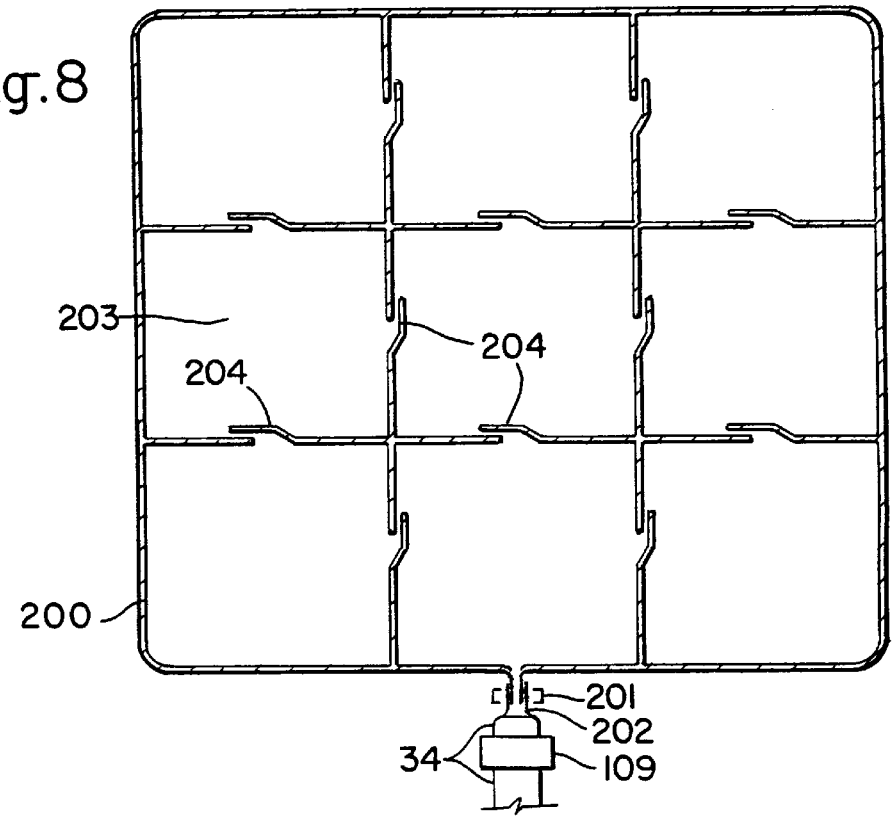
FIG. 8 is a cross section of the bag illustrated in FIG. 7, with sub-bags having flap covered apertures.

FIG. 6 is an illustration of a bag configuration designed to fit a sub-compartment 20 of a retrofitted hull of a vessel. The bag 200 is attached to the distribution system extension 34 to allow for the introduction of the foam precursor material. The bag is attached by a clamp 201 to a nozzle 202 on the distribution system extension 34 beyond valve 109. At such time as the bag 200 is filled with the foam material, as shown in FIG. 7, the bag 200 is expanded to fit the dimensions of the sub-compartment 20. In a further embodiment shown in FIG. 8 is a cross section through the mid section of the bag 200, the bag 200 may comprise sub-bags 203 therein, where each sub-bag 203 is connected to neighboring sub-compartments by means of flap covered apertures 204 for communicating with adjoining sub-bags 203 and for providing for the flow of the foamable cast-cure plastic material there between. The sub-bag 203 is further connected to a nozzle 202 which is then connected to the distribution system 30 which directly supplies the foam precursor material to the bag 200. In an active double hull protection system comprising sub-compartments 20 with the dimensions of 10 meters wide by 10 meters high by 10 meters in depth, the sub-compartment 20 can be designed to have a bag 200 attached to the distribution system for providing for the introduction of the foamable cast-cure plastic material. Prior to the introduction of the foamable cast-cure plastic material, the bag 200 is initially in a collapsed form. However, upon delivery of the foamable cast-cure plastic material, the bag 200 expands to the full volume of the sub-compartment 20. Damage to any one of the sub-bags 203 would leave the remaining sub-bags 203 in the sub-compartment 20 functional. Accordingly, the sub-compartments 20 of an active double hull protection system can be designed to have a collapsed bag 200 attached to the distribution system 30 for the introduction of the foam precursor which upon expansion by the foam may expand to the full volume of the sub-compartment 20.

Moreover, the bag 200 may be structured so as to contain sub-bags 203 therein, where each bag 200 is connected to the pipe extensions 34 that provides the foamable cast-cure plastic material. Damage to any one of the sub-bags 203 would still leave the remaining sub-bags 203 functional, protecting the foam precursor against excessive dilution during the setup time. Porting to the piping system can consist of individual pipes. However, since the purpose of the bag 200 is merely to provide a temporary interface between a foamable precursor material and any solvent material, porting to the piping system can be achieved simply by means of slits or flap openings in the walls common to adjoining sub-bag section of the bag.

The above description is of a novel apparatus and method for protecting a vessel, such as a tanker, in the event a breach of the hull occurs. Although the present invention has been described in connection with preferred embodiments thereof, it will be appreciated by those skilled in the art that additions, deletions, modifications, and substitutions not specifically described may be made without departing from the spirit and scope of the invention as defined in the appended claims and the scope should not be limited to the dimensions indicated herein above.

What is claimed:

1. A protective system for a storage vessel hull, comprising:

sheets of lath work panels extending from a series of longitudinal and transverse structure members of the vessel for dividing the hull into a plurality of sub-compartments;

said lath work panels further comprising a plurality of apertures for permitting the flow of liquid cargo to enter and exit the sub-compartments during normal operation and for providing a sealing platform in the event of a breach;

a distribution system extending through the hull of the vessel and the sub-compartments therein;

a sensing means for detecting a breach in the hull; and a control system for delivering a foamable cast-cure plastic material to a compromised area of the hull, wherein said plastic material becoming affixed to the panels and the lath work panels supporting the cast-cure plastic material against the pressure of the seawater and liquid cargo pressure differential.

2. The protective system of claim 1, wherein said foamable cast-cure plastic material being a fire resistant foam material for sealing a breach in the hull.

3. The protective system of claim 2, wherein the control system further comprising a reservoir centrally placed within the vessel for delivering the foamable cast-cure plastic material to the distribution system.

4. The protective system of claim 3, wherein the distribution system delivering the foamable cast-cure plastic material to the sub-compartment experiencing the breach.

5. The protective system of claim 4, wherein the distribution system further comprising a pressurization apparatus for delivering the foamable cast-cure plastic material from the reservoir through the distribution system.

6. The protective system of claim 5, wherein said sensing system comprising sensors in each sub-compartment for detecting a breach in the hull.

7. The protective system of claim 6, wherein said sensing means being electrical for detecting the conductivity of the seawater entering the sub-compartment.

8. The protective system of claim 6, wherein said sensing system being acoustical and comprising hydro phones for detecting a sound of impact upon a breach of the hull.

9. The protective system if claim 6, wherein said sensing system comprising a photo detection means for detecting a change in illumination within a sub-compartment.

10. The protective system of claim 6, wherein the sensing system comprising a tie rod structure incorporate into the lath work and the hull for transmitting a motion to a valve upon a breach of the hull.

11. The protective system of claim 1, wherein said apertures having a diamond shape.

12. The protective system of claim 1, wherein said apertures having a circular shape.

13. The protective system of claim 1, wherein said lath panel being comprised of a steel material.

14. A kit adapted to be attached to an existing vessel hull, comprising:

sheets of lath work panels extending from a series of longitudinal and transverse structure of the vessel for dividing the hull into a plurality of sub-compartments;

a distribution system extending through the vessel hull and the sub-compartments therein;

a sensing and control system for detecting a breach in the vessel hull; and a control system for delivering a foamable cast-cure plastic material to a sub-compartment adjacent to the hull area affected by the breach.

15. The kit of claim 14, wherein said foamable cast-cure material being a fire resistant material acting as a means for sealing a breach in the hull.

16. The kit of claim 14, wherein said lath work panels being comprised of a steel material.

17. A method of protecting a vessel's hull comprising the steps of:

retrofitting an existing hull with a plurality of sub-compartments around an inside perimeter of the hull, each sub-compartment comprising walls from the existing vessel hull and from lath work panels extending from longitudinal and transverse structures within the hull, said lath work panels comprising a plurality of apertures extending through the panel to allow liquid cargo to enter and exit the sub-compartments during normal operating conditions;

extending a piping system from a centrally placed reservoir throughout each sub-compartment;

sensing a breach in the hull of the vessel; and delivering a foamable cast-cure plastic material to a sub-compartment adjacent to an area of the breach, wherein said plastic material effectively sealing said lath work panels apertures and said panels holding and supporting said plastic material against the pressure of seawater and liquid cargo differential for preventing leakage of vessel cargo.

18. The method of claim 17, further comprising the steps of extending lath work panels from longitudinal and transverse structures within the hull for forming walls of the sub-compartments.

19. The method of claim 17, comprising the steps of effectively sealing a breach in the hull by delivering a fire resistant foamable cast-cure plastic material from a central reservoir to an area of the hull breach.

20. A protective system for a storage vessel hull, comprising:

sheets of lath work panels for dividing the inner surface area of the hull into a plurality of sub-compartments, each sub-comaprtment comprising walls from the existing vessel hull and from lath work panels extending from longitudinal and transverse structures within the hull, said lath work panels comprising a plurality of apertures extending through the panel to allow flow of liquid cargo through the panels and adjacent sub-compartments;

a first container placed in each sub-compartment for storing an unpolymerized liquid under pressure, wherein upon release of the unpolymerized liquid a cast-cure foamable plastic material is formed and seals the apertures of the lath work panels effectively forming a solid wall adapted to withstand the pressure of the seawater and liquid cargo differential.

21. The protective system of claim 20, further comprising a second container placed within the first container, wherein said second container comprising a chemical additive for initiating polymerization of the stored unpolymerized liquid in the first container.

22. The protective system of claim 21, wherein said second container comprising a channel extending from the second container to a lid of the first container connecting the two containers.

23. The protective system of claim 22, wherein at such time as the first container is subject to a pressure causing the lid to be displaced, the contents of the first container and the second container react producing a polymer foam material for filling the space within the sub-compartment and effectively sealing the breach of the hull adjacent to the sub-compartment.

24. A protective system for a storage vessel hull, comprising:

sheets of lath work panels for dividing an inner surface area of the hull into a plurality of sub-compartments, each sub-compartment comprising walls from the existing vessel hull and from lath work panels extending from longitudinal and transverse structures within the hull, said lath work panels comprising a plurality of apertures extending through the panel to allow flow of liquid cargo through the panels and adjacent sub-compartments;

a distribution system extending through the vessel and the sub-compartments therein;

a bag placed in each sub-compartment having an aperture for attaching to a pipe of the distribution system;

a sensing system for detecting a breach in the hull; and a control system for delivering a foamable cast-cure plastic material to a bag placed in the sub-compartment adjacent to an area of the hull experiencing the breach wherein upon release of the unpolymerized liquid a cast-cure foamable material is formed for sealing the affected sub-compartment and said lath work panels in combination with said cast-cure foamable material being adapted to withstand the pressure of the seawater and liquid cargo differential.

25. The protective system of claim 24, wherein said distribution system providing a fire resistant foamable cast-cure plastic material to a bag displaced within a sub-compartment adjoining the area experiencing a breach of the hull.

26. The protective system of claim 25, wherein said bag further comprising a plurality of sub-compartments therein and wherein said bag is connected to the distribution system.

27. The protective system of claim 26, wherein each bag sub-bag comprising apertures for communicating with an adjoining bag sub-bag for providing for the flow of the foam material there between.

28. The protective system of claim 21, wherein said bag being comprised of a rubber material.

29. The protective system of claim 24, wherein said bag being comprised of a plastic material.

* * * * *